US006637859B2

(12) United States Patent
Williamson et al.

(10) Patent No.: US 6,637,859 B2
(45) Date of Patent: Oct. 28, 2003

(54) INK JET MIST CONTROL SYSTEM

(75) Inventors: Randal Scott Williamson, Lexington, KY (US); Martin Alan Johnson, Winchester, KY (US); Mark Aaron Neal, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 126 days.

(21) Appl. No.: 10/073,798

(22) Filed: Feb. 11, 2002

(65) Prior Publication Data

US 2003/0151638 A1 Aug. 14, 2003

(51) Int. Cl.[7] ..... B41J 2/165; B41J 2/185
(52) U.S. Cl. ..... 347/36; 347/34
(58) Field of Search ..... 347/34, 36, 89, 347/90

(56) References Cited

U.S. PATENT DOCUMENTS

| | | | | |
|---|---|---|---|---|
| 4,361,845 | A | 11/1982 | Smith | 346/140 |
| 4,369,450 | A | 1/1983 | Iwagami et al. | 346/75 |
| 5,477,256 | A | 12/1995 | Loyd et al. | 347/93 |
| 5,517,221 | A | 5/1996 | Nguyen | 347/31 |
| 5,559,540 | A | 9/1996 | Burolla | 347/45 |
| 5,563,639 | A | 10/1996 | Cameron et al. | 347/34 |
| 5,659,342 | A | 8/1997 | Lund et al. | 347/35 |
| 5,680,162 | A | 10/1997 | Taylor et al. | 347/35 |
| 5,714,991 | A | 2/1998 | Osborne et al. | 347/30 |
| 5,719,603 | A | 2/1998 | Nguyen | 347/31 |
| 5,742,303 | A | 4/1998 | Taylor et al. | 347/36 |
| 5,774,139 | A | 6/1998 | Salzer et al. | 347/32 |
| 5,774,141 | A | 6/1998 | Cooper et al. | 347/34 |
| 5,774,142 | A | 6/1998 | Nguyen et al. | 347/35 |
| 5,949,448 | A | 9/1999 | Man et al. | 347/33 |
| 5,980,018 | A | 11/1999 | Taylor et al. | 347/31 |
| 5,997,128 | A | 12/1999 | Lou et al. | 347/33 |
| 6,042,216 | A | 3/2000 | Garcia et al. | 347/29 |
| 6,042,218 | A | 3/2000 | Nakahara | 347/35 |
| 6,050,671 | A | 4/2000 | Rotering | 347/35 |
| 6,102,518 | A | 8/2000 | Taylor | 347/29 |
| 6,132,026 | A | 10/2000 | Taylor et al. | 347/32 |
| 6,168,258 | B1 | 1/2001 | Lou et al. | 347/33 |
| 6,193,353 | B1 | 2/2001 | Vives et al. | 347/29 |
| 6,234,621 | B1 | 5/2001 | Musser et al. | 347/92 |
| 6,247,783 | B1 | 6/2001 | Shibata et al. | 347/35 |
| 6,270,212 | B1 | 8/2001 | Kusumi et al. | 347/93 |

*Primary Examiner*—Huan Tran
(74) *Attorney, Agent, or Firm*—Taylor & Aust, P.C.

(57) ABSTRACT

A receptacle for the color ink spitting of a printhead to maintain the print nozzles and better collect the ink and transfer the waste ink to a containment area utilizes a porous open cell foam spit surface to allow the waste ink and air to pass through while maintaining some surfaces for the transport and collection of waste ink. This open cell design of the foam allows the ink and air to pass through it without deflecting the vast majority of the ink volume. The foam is hydrophobic foam to prevent the foam from absorbing the ink. The foam is also made from an ether-based material to be compatible with the inks. Walls forming a chimney are added to the sides of the foam to help contain and direct the waste ink flow from the printhead to the waste ink accumulation area in the printer. The spit foam and chimney direct the waste ink directly onto a felt absorption pad located below the spit surface where the waste ink is absorbed and stored. The felt pad is used in place of a hard spit surface to collect any ink that jets through the foam filled chimney. To help reduce or eliminate ink fogging, a pause time is built into the controls. Delaying the movement of the carrier until the fog or mist is below the spit surface reduces or eliminates the contamination of other parts of the printer. Color ink is spit first then monochrome ink. The spitting of monochrome ink after the color ink gives a built in delay before moving the carrier and thus allows more time for the color ink to migrate through the spit foam and away from the printhead. Additional carrier delay time may also built into the controls to further reduce or eliminate ink fogging.

17 Claims, 3 Drawing Sheets

INK JET MIST CONTROL SYSTEM

BACKGROUND OF THE INVENTION

1. Field of the invention

The present invention relates to inkjet printers and more particularly to a method and apparatus for controlling mist associated with printer printhead maintenance.

2. Description of the related art

Inkjet printers typically employ a reciprocable carriage supporting one or more print heads. Printhead maintenance requires periodic jetting, sometimes called spitting, of ink droplets to clear contamination from nozzles or to ensure proper ink chemistry at the nozzle openings. The droplets are frequently collected in a waste ink reservoir called a spittoon. This ink droplet firing, as a part of a maintenance algorithm, occurs to clear the printhead nozzles of contamination or to prevent ink chemistry changes at the nozzle openings due to crusting, viscosity changes, or separation of ink constituents. A common problem is the fragmentation of the ink droplet during jetting. These fragmentary droplets are often referred to as "mist." The mist may result in misting on the printed page, discoloring of features inside the printer, and, possibly, discoloring of articles surrounding the printer. Mist problems are exacerbated in color printers because the color inks are typically dye-based inks whereas the black ink is typically a pigment-based ink. The dye-based color inks are less dense and more prone to mist formation, and the mist which is formed lingers longer.

The jetting of ink and other maintenance tasks such as printhead nozzle wiping and capping are performed at a maintenance station at one extreme of printhead carriage travel. Sometimes, the printhead carrier will drag ink fog or mist along with it as it departs from the maintenance station to perform a printing task, contaminating other parts of the printer with waste ink.

A traditional method of controlling ink misting during maintenance is to provide a surface near the nozzle openings for ink mist and residue to accumulate. A surface and containment area is required for spitting of waste ink to maintain an inkjet printer printhead. In the past, inkjet printers have used hard surfaces onto which ink is spit to reduce satellites, which form mist. This technique takes advantage of viscous properties in the ink. The ink hits the surface and leaks down to a containment area. The disadvantage of a hard surface is that the more ink that is spit, the more rebound the ink has and the mist is still a problem as it will contaminate the printer. This surface and containment area is critical in keeping the waste ink and related ink fog or mist from migrating to other areas of the printer.

The assignee of the present invention has employed a spittoon in the form of a funnel having a foam filter material therein through which the jetted ink passed into an open waste ink containment area, however, ink mist within the open area was difficult to capture and sometimes escaped when the printhead was moved away from the spittoon preparatory to a printing task. Other techniques utilizing ventilating fans, spit wheels or capping the spittoon when not in use have also been suggested, but contamination due to printer ink mist remains a problem.

SUMMARY OF THE INVENTION

A surface is required for the color ink spitting of a printhead to maintain the print nozzles. This surface should contain and direct the waste ink flow to a desirable accumulation area in the printer. The present invention provides a surface in the form of a porous open cell foam spit surface and adjacent felt pad. The open cell foam allows the waste ink and air to pass through while maintaining some surfaces for the transport and collection of waste ink. Adjacent the foam is the absorbent pad for receiving and retaining the ink. The ink and air pass through the foam very quickly and efficiently and onto the collection surface. The open cell design of the foam allows the ink and air to pass through it without deflecting the vast majority of the ink volume. The foam is a hydrophobic foam to prevent the foam from absorbing the ink. The foam is also an ether-based material which is compatible with the inks.

The invention comprises, in one form thereof, a technique where waste ink which is jetted from an inkjet printer printhead toward an adjacent waste ink accumulating surface is confined and controlled by ejecting ink from the printhead into a hydrophobic open cell foam while laterally confining the ejected ink within the foam, and collecting the ink which passes through the foam in a closely adjacent felt pad. The felt pad functions as the waste ink accumulating surface. A printing operation is performed a fixed time interval after ejection of ink from the printhead. The printhead may be moved to a different location and ink ejected from a second printhead into the hydrophobic open cell foam during the fixed time interval.

An advantage of the present invention is that the foam and pad combination is better able to collect the ink and maintain a way to transfer the waste ink to the containment area.

Another advantage is the passing of this ink and air through the foam occurs very quickly and efficiently as is important to the printer function and thruput.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
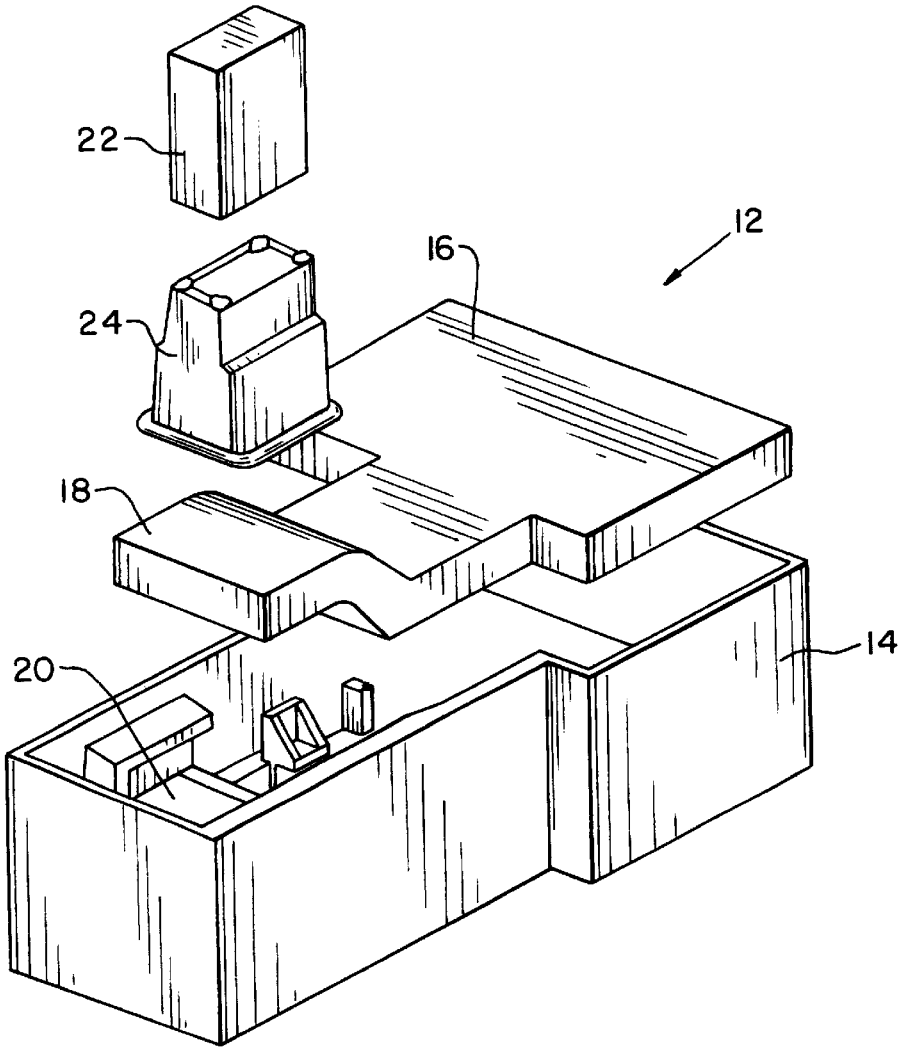
FIG. 1 is an exploded perspective view of a waste ink receptacle according to the present invention.

Referring now to the drawings and particularly to FIG. 1, there is shown a waste ink receptacle or spittoon 12 in an exploded perspective view. The bottom portion of the receptacle 12 includes a tray 14 which provides a waste ink accumulation area, and an absorptive felt tray liner or pad 16. One end of the felt pad 16 is deviated upwardly as indicated at 18 and supported by an elevated portion 20 of the tray to be in closer proximity to the ejected ink from a printhead 26 (FIG. 2) and to encourage the accumulation of waste ink in the bottom of the tray. A hydrophobic porous open cell foam block 22 is housed within an open ended generally rectangular parallelepiped chimney 24. The chimney 24 defines an ink entrance pathway having a sidewall region of ink impervious material, such as a plastic, and is open at the opposite upper and lower ends to allow spit ink to enter one end and exit the other end while limiting lateral movement of the ink. The ink entrance pathway functions to convey ink spit from the printhead 26 to the tray liner elevated portion 18 and extends generally vertically through the foam block 22 within the chimney 24. Thus, the foam medium is disposed in the ink entrance pathway and the ink spit from the printhead 26 has sufficient velocity to pass through the foam medium 22 on its way to the tray liner portion 18. The absorptive tray liner 16 comprises a relatively soft flexible felt material with the elevated portion 18, which lies in close proximity to the foam medium 22, forming an ink capturing surface.

The foam medium 22 is liquid permeable and formed of a somewhat sponge-like porous open cell hydrophobic material and is preferably made of an ink compatible polyether-based material. Foam media are used in various filtering applications and are typically either polyester based or polyether based. The polyether based materials are more heat resistant, less prone to degradation and generally better suited to use in the present invention.

Figure 2:
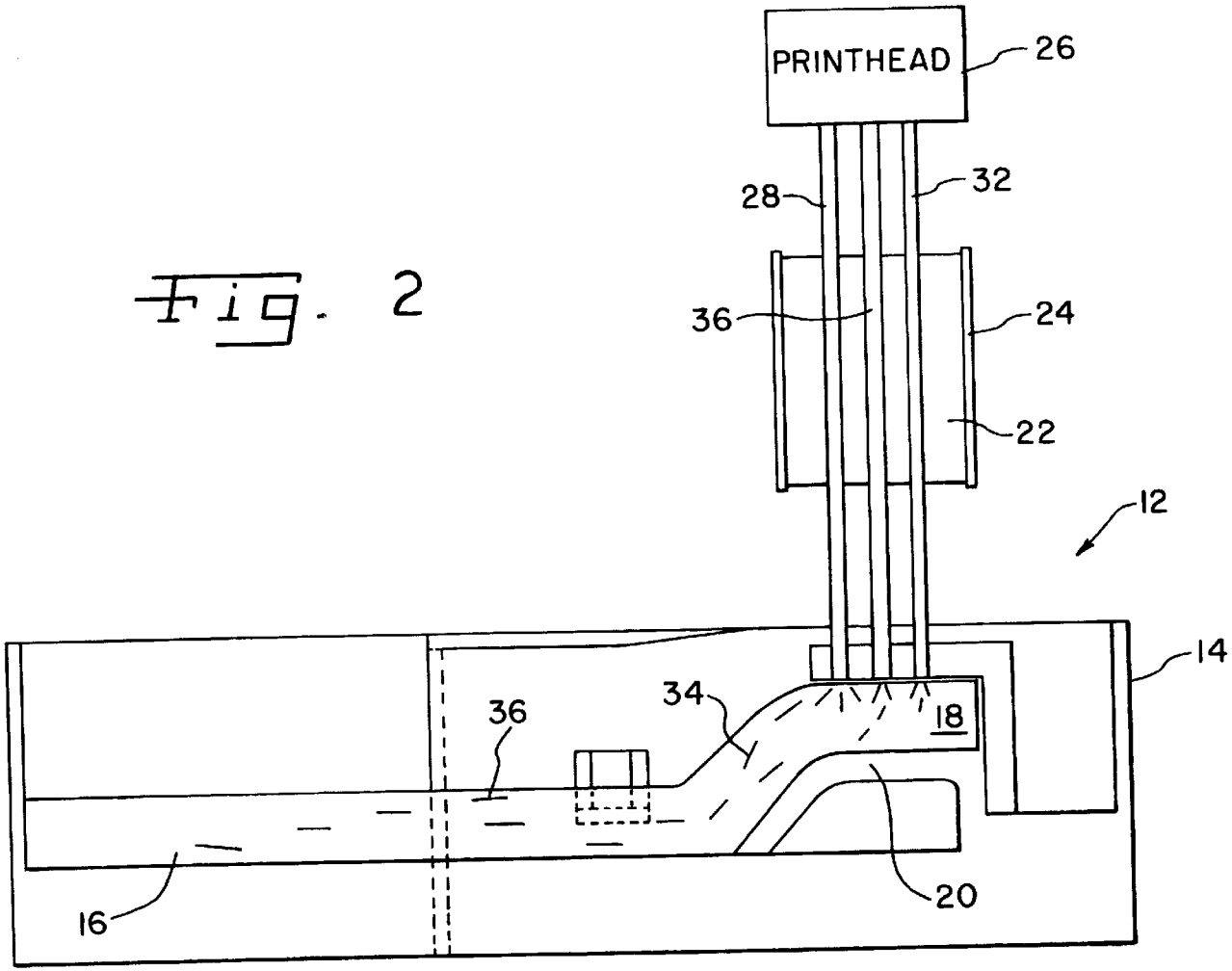
FIG. 2 is a cross-sectional view of the receptacle of FIG. 1 along line 2—2 schematically illustrating ejected ink flow paths.

In FIG. 2, an exemplary color printhead 26 having three colors, e.g., cyan, magenta and yellow, ejects three streams of ink 28, 30 and 32 from appropriate nozzles upon command. The ejected ink is guided by the chimney 24 and most of the ink passes through the foam medium 22 impinging on the ink capturing surface 18. The felt pad 16 wicks the captured ink away from the elevated region 18 as indicated by lines such as 34 and 36, and holds this waste ink in an ink accumulation area in the lower portion of tray 14. A second printhead supported on the same carriage (not shown) containing black ink and/or another set of color inks may be similarly purged by ejecting ink through the foam medium 22 and into the pad region 18. The purging of the second printhead may, in some cases, include repositioning the carriage or repositioning a maintenance sled which supports the spittoon 12 as well as other structures to locate the spittoon beneath the second printhead.

Figure 3:
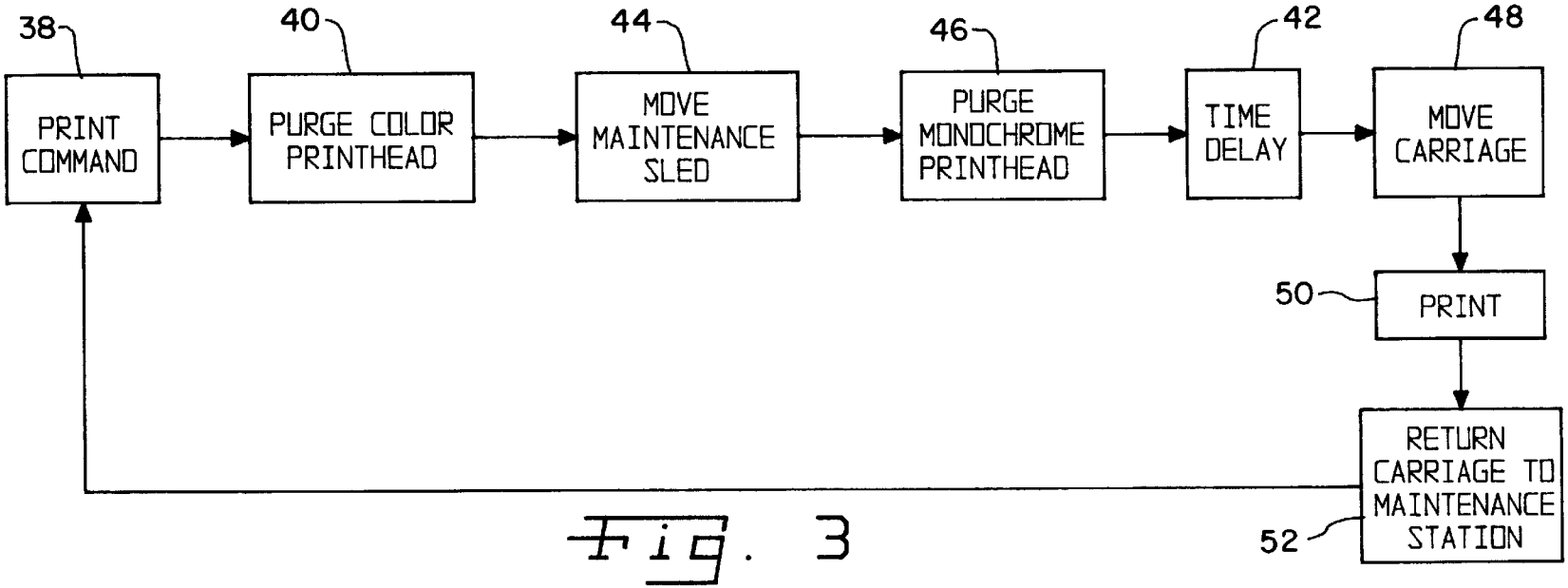
FIG. 3 is a schematic illustration of a printhead servicing process according to the present invention.

In its quiescent state, an ink jet printer has a carriage which supports both color and monochrome (black ink) printheads parked near one extreme of its travel with the printheads aligned with a sled supported maintenance station or service location. That station may perform several tasks such as wiping or capping printhead nozzles as well as the ink ejection or spitting preparatory to a printing operation. In FIG. 3, the carriage awaits a print command 38 and, upon receipt of that command, the color printhead executes a nozzle purging or spitting operation as indicated at 40. The maintenance sled may optionally be moved to align the monochrome printhead with the spittoon as indicated at 44. Ink is ejected from the monochrome printhead into the spittoon as shown at 46. When the spitting operation is completed, a fixed time delay 42 is initiated. Upon expiration of the time delay, the carriage is moved as at 48 from its parked position at the service location to perform the printing operation as shown at 50. Upon completion of the printing task, the carriage returns to the maintenance station as shown at 52. Of course, periodic maintenance may also be performed at other than the completion or commencement of a printing task, for example, during an extensive printing project.

Figure 4:
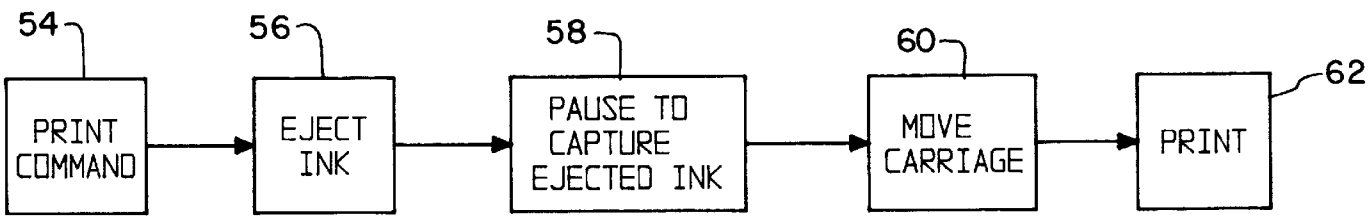
FIG. 4 is a schematic illustration of the process of purging one printhead.

The process of purging a color printhead may be described in somewhat greater detain in conjunction with FIG. 4. The printhead is initially located at a service location near one extreme of printer carriage travel awaiting receipt of a print command. Ink is ejected from the printhead into the liquid permeable foam medium 22 upon receipt of a print command 54 as shown at 56. The portion of the ejected ink which passes through the foam medium is captured in absorbent material 16 as indicated at 58. Associated with the capture is a time period pause subsequent to the step of ejecting ink of a fixed time interval to allow ink particles to exit the region between the printhead and foam medium. A delay period of 600 milliseconds after termination of spitting from the nozzles has been found suitable in one application. Also, during the pause to capture the ejected ink, a monochrome printhead may be purged. As noted earlier, misting problems with monochrome printheads are not as severe, thus a time delay after jetting from the monochrome nozzle is frequently not required. Upon expiration of the fixed time interval, the carriage is moved as shown at 60 away from the maintenance station and a printing operation 62 commences.

In summary, the hydrophobic foam 22 is located within a hard plastic chimney 24 attached to the maintenance sled of the maintenance assembly. The walls of the chimney direct the waste ink flow from the printhead 26 to the waste ink accumulation area in the printer. The spit foam and chimney direct the waste ink directly onto a felt absorption pad 16 located below the spit surface where the waste ink is absorbed and stored. To help reduce or eliminate ink fogging, pause time is built into the controls. The pause time reduces the likelihood that the printhead carrier will drag ink fog or mist along with it, contaminating other parts of the printer with waste ink. The delaying the movement of the carrier until the fog or mist is below the spit surface reduces the contamination of other parts of the printer. Also, spitting of more dense monochrome ink after the lighter color ink provides some built in delay before moving the carrier, and thus allows more time for the color ink to migrate through the spit foam and away from the printhead.

While this invention has been described in conjunction with a printer, the techniques are equally applicable to similar printheads in other inkjet image forming devices such as copiers or facsimile machines. The invention has been described as having a preferred design, however, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A waste ink receptacle, comprising:

a tray;

an absorptive tray liner;

an ink entrance pathway for conveying ink spit from a printhead to the tray liner; and a foam medium disposed in the ink entrance pathway through which ink spit from the printhead must pass on its way to the tray liner.

2. The waste ink receptacle of claim 1, wherein the ink entrance pathway is formed of a sidewall region of ink impervious material open at opposite ends to allow spit ink to enter one end and exit the other end.

3. The waste ink receptacle of claim 2, wherein the sidewall region has a generally rectangular parallelepiped shape.

4. The waste ink receptacle of claim 1, wherein the foam medium comprises a hydrophobic material.

5. The waste ink receptacle of claim 1, wherein the foam medium comprises an ink compatible ether-based material.

6. The waste ink receptacle of claim 1, wherein the absorptive tray liner includes an elevated portion in close proximity to the foam medium forming an ink capturing surface.

7. The waste ink receptacle of claim 1, wherein the foam medium comprises a hydrophobic porous open cell foam.

8. The waste ink receptacle of claim 1, wherein the absorptive tray liner comprises a relatively soft flexible absorbent felt material.

9. A process of servicing a carriage supported inkjet printer printhead, comprising the steps of:

moving the printhead to a service location near one extreme of printer carriage travel;

awaiting receipt of a print command;

ejecting ink from the printhead into a liquid permeable foam medium upon receipt of a print command;

capturing ejected ink which passes through the foam medium in an absorbent material;

pausing subsequent to the step of ejecting ink a fixed time interval to allow ink particles to exit the region between the printhead and foam medium; and commencing a printing operation upon expiration of the fixed time interval.

10. The process of claim 9, further including the step of ejecting ink from a second printhead into the liquid permeable foam medium and capturing ejected ink which passes through the foam medium in the absorbent material.

11. The process of claim 10, wherein the first printhead ejects colored dye based inks and the second printhead ejects one of a black pigment based ink and a colored dye based ink.

12. The process of claim 9, further including the step of limiting lateral movement of the ejected ink.

13. The process of claim 9, wherein the liquid permeable foam medium comprises a hydrophobic porous open cell foam and the absorbent material comprises a relatively soft felt absorbent pad located in close proximity to the foam.

14. A process of confining and controlling waste ink jetted from an inkjet printhead toward an adjacent waste ink accumulating surface, comprising the steps of:

ejecting ink from the printhead into a hydrophobic open cell foam;

laterally confining the ejected ink within the foam; and collecting ink passing through the foam in a closely adjacent felt pad.

15. The process of claim 14, wherein the felt pad functions as the waste ink accumulating surface.

16. The process of claim 14, wherein an image forming operation is performed a fixed time interval after ejection of ink from the printhead.

17. The process of claim 16, further comprising the steps of moving the printhead and ejecting ink from a second printhead into the hydrophobic open cell foam.

* * * * *